US011187172B2

(12) United States Patent
Ikeda et al.

(10) Patent No.: US 11,187,172 B2
(45) Date of Patent: Nov. 30, 2021

(54) CONTROLLER AND CONTROL METHOD FOR INTERNAL COMBUSTION ENGINE

(71) Applicant: TOYOTA JIDOSHA KABUSHIKI KAISHA, Toyota (JP)

(72) Inventors: Yuto Ikeda, Toyota (JP); Yuki Nose, Kasugai (JP); Yoshiyuki Shogenji, Toyota (JP); Hirokazu Ando, Kariya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/147,748

(22) Filed: Jan. 13, 2021

(65) Prior Publication Data

US 2021/0131369 A1 May 6, 2021

Related U.S. Application Data

(63) Continuation of application No. 16/458,293, filed on Jul. 1, 2019, now Pat. No. 10,907,560.

(30) Foreign Application Priority Data

Aug. 7, 2018 (JP) ..... JP2018-148074

(51) Int. Cl.
*F02D 41/02* (2006.01)

(52) U.S. Cl.
CPC ..... *F02D 41/0295* (2013.01)

(58) Field of Classification Search
CPC .... F02D 41/02; F02D 41/029; F02D 41/0295; F02D 17/02; F02D 2200/04; F02D 2200/08; F02D 2200/0814; F01N 11/00; F01N 11/007; F01N 3/02; F01N 3/0253; F01N 3/03; F01N 3/035; F01N 3/20; F02P 5/15; F02P 5/045; B01D 53/94; B01D 53/9454; B01D 53/9495
USPC ..... 123/198 DB; 701/102–105, 108, 109, 701/112, 113
See application file for complete search history.

(56) References Cited

U.S. PATENT DOCUMENTS

| | | | |
|---|---|---|---|
| 6,282,889 | B1 | 9/2001 | Kakuyama et al. |
| 9,650,981 | B1 | 5/2017 | Large et al. |
| 2003/0041593 | A1 | 3/2003 | Yoshida et al. |
| 2006/0278202 | A1 | 12/2006 | Sieber et al. |
| 2008/0276602 | A1 | 11/2008 | McCabe et al. |

(Continued)

FOREIGN PATENT DOCUMENTS

| | | | |
|---|---|---|---|
| DE | 102016124427 | A1 | 6/2017 |
| EP | 1625300 | B1 | 6/2009 |

OTHER PUBLICATIONS

May 20, 2020 Office Action issued in U.S. Appl. No. 16/458,293.
Sep. 11, 2020 U.S. Notice of Allowance issued in U.S. Appl. No. 16/458,293.

*Primary Examiner* — John Kwon
*Assistant Examiner* — Johnny H Hoang
(74) *Attorney, Agent, or Firm* — Oliff PLC

(57) ABSTRACT

An engine controller executes a fuel introduction process of introducing, in a state in which the crankshaft of an internal combustion engine is rotating, air-fuel mixture that contains fuel injected by a fuel injection valve into the exhaust passage without burning the air-fuel mixture in the cylinder. When the oxygen concentration of exit gas that has passed through a three-way catalyst decreases during the execution of the fuel introduction process, the engine controller executes a stopping process of stopping the fuel introduction process.

5 Claims, 4 Drawing Sheets

(56) References Cited

U.S. PATENT DOCUMENTS

| | | | |
|---|---|---|---|
| 2012/0031170 | A1 | 2/2012 | Matsumoto et al. |
| 2012/0310512 | A1 | 12/2012 | Aoki et al. |
| 2012/0317960 | A1 | 12/2012 | Sato |
| 2014/0041362 | A1 | 2/2014 | Ulrey et al. |
| 2016/0281625 | A1 | 9/2016 | Nakajima |
| 2018/0355774 | A1 | 12/2018 | Sudschajew |
| 2019/0120154 | A1 | 4/2019 | Teraya |
| 2019/0301390 | A1 | 10/2019 | Miyata et al. |
| 2020/0049121 | A1 | 2/2020 | Ikeda et al. |

CONTROLLER AND CONTROL METHOD FOR INTERNAL COMBUSTION ENGINE

CROSS-REFERENCE TO RELATED APPLICATION(S)

This application is a continuation of U.S. application Ser. No. 16/458,293 filed Jul. 1, 2019, which is based on and claims priority under 35 U.S.C. 119 from Japanese Patent Application No. 2018-148074 filed on Aug. 7, 2018. The contents of the above applications are incorporated herein by reference.

BACKGROUND

1. Field

The following description relates to a controller and a control method for an internal combustion engine.

2. Description of Related Art

US Patent Application Publication No. 2014/41362 discloses a spark-ignition internal combustion engine. This internal combustion engine is equipped with a three-way catalyst and a filter that collects particulate matter. The three-way catalyst is arranged in the exhaust passage. The filter is located in the exhaust passage on the downstream side of the three-way catalyst.

In U.S. Patent Application Publication No. 2014/41362, a fuel introduction process is executed to increase the temperature of the three-way catalyst while the vehicle is coasting, thereby burning and removing particulate matter deposited in the filter. In the fuel introduction process, fuel injection is performed with the spark discharge of the ignition plug stopped. Then, the air-fuel mixture is introduced into the exhaust passage without being burned in the cylinder. The unburned air-fuel mixture flows from the exhaust passage into the three-way catalyst and is burned in the three-way catalyst. The heat generated by the combustion increases the temperature of the three-way catalyst and also increases the temperature of the gas flowing into the filter from the three-way catalyst. This increases the filter temperature to the ignition point of the particulate matter. As a result, the particulate matter deposited in the filter is burned and removed.

During the combustion operation of the internal combustion engine described above, the air-fuel ratio sensor installed in the exhaust passage detects the air-fuel ratio of the air-fuel mixture burned in the cylinder, and an air-fuel ratio feedback control is executed in accordance with the detection result of the air-fuel ratio. Specifically, by correcting the fuel injection amount through the air-fuel ratio feedback control, the deviation of the fuel injection amount of the fuel injection valve is compensated for.

In contrast, when the fuel introduction process is executed, the air-fuel ratio feedback control cannot be executed because combustion in the cylinder is stopped. Therefore, the amount of fuel actually injected from the fuel injection valve (actual injection amount) may deviate from the amount instructed by the controller (instructed injection amount). As a result, the actual injection amount may exceed the instructed injection amount, so that the fuel concentration in the air-fuel mixture increases to such an extent that the air-fuel ratio of the unburned air-fuel mixture flowing in the exhaust passage becomes richer than the stoichiometric air-fuel ratio. This is likely to bring about the following drawbacks.

When unburned air-fuel mixture of a high fuel concentration flows into the three-way catalyst due to the execution of the fuel introduction process, the fuel in the air-fuel mixture is burned by using not only the oxygen contained in the air-fuel mixture but also the oxygen stored in the three-way catalyst. When this reduces the oxygen storage amount of the three-way catalyst, some of the fuel contained in the air-fuel mixture may easily pass through the three-way catalyst without being burned due to the oxygen deficiency, so that the emission may deteriorate.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In a first general aspect, a controller for an internal combustion engine is provided. The internal combustion engine includes a fuel injection valve, a cylinder into which air-fuel mixture containing fuel injected by the fuel injection valve is introduced, an ignition device that spark-ignites the air-fuel mixture introduced into the cylinder, an exhaust passage through which gas discharged from inside the cylinder flows, a three-way catalyst provided in the exhaust passage, and a sensor that is provided in the exhaust passage and detects a state of an oxygen concentration of exit gas, which is gas that has passed through the three-way catalyst. The controller is configured to execute: a fuel introduction process of introducing, in a state in which a crankshaft of the internal combustion engine is rotating, the air-fuel mixture that contains the fuel injected by the fuel injection valve into the exhaust passage without burning the air-fuel mixture in the cylinder; and a stopping process of stopping the fuel introduction process when a detection value of the sensor indicates a decrease of the oxygen concentration of the exit gas during the execution of the fuel introduction process.

In a second general aspect, a controller for an internal combustion engine is provided. The internal combustion engine includes a fuel injection valve, a cylinder into which air-fuel mixture containing fuel injected by the fuel injection valve is introduced, an ignition device that spark-ignites the air-fuel mixture introduced into the cylinder, an exhaust passage through which gas discharged from inside the cylinder flows, a three-way catalyst provided in the exhaust passage, and a sensor that is provided in the exhaust passage and detects a state of an oxygen concentration of exit gas, which is gas that has passed through the three-way catalyst. The controller includes circuitry that is configured to execute: a fuel introduction process of introducing, in a state in which a crankshaft of the internal combustion engine is rotating, the air-fuel mixture that contains the fuel injected by the fuel injection valve into the exhaust passage without burning the air-fuel mixture in the cylinder; and a stopping process of stopping the fuel introduction process when a detection value of the sensor indicates a decrease of the oxygen concentration of the exit gas during the execution of the fuel introduction process.

In a third general aspect, a control method for an internal combustion engine is provided. The internal combustion engine includes a fuel injection valve, a cylinder into which air-fuel mixture containing fuel injected by the fuel injection valve is introduced, an ignition device that spark-ignites the air-fuel mixture introduced into the cylinder, an exhaust passage through which gas discharged from inside the cylinder flows, a three-way catalyst provided in the exhaust passage, and a sensor that is provided in the exhaust passage and detects a state of an oxygen concentration of exit gas, which is gas that has passed through the three-way catalyst. The control method comprises: introducing, in a state in which a crankshaft of the internal combustion engine is rotating, the air-fuel mixture that contains the fuel injected by the fuel injection valve into the exhaust passage without burning the air-fuel mixture in the cylinder; and stopping the fuel introduction process when a detection value of the sensor indicates a decrease of the oxygen concentration of the exit gas during the execution of the fuel introduction process.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A controller 100 for an internal combustion engine 10 according to an embodiment will now be described with reference to FIGS. 1 to 3.

Figure 1:
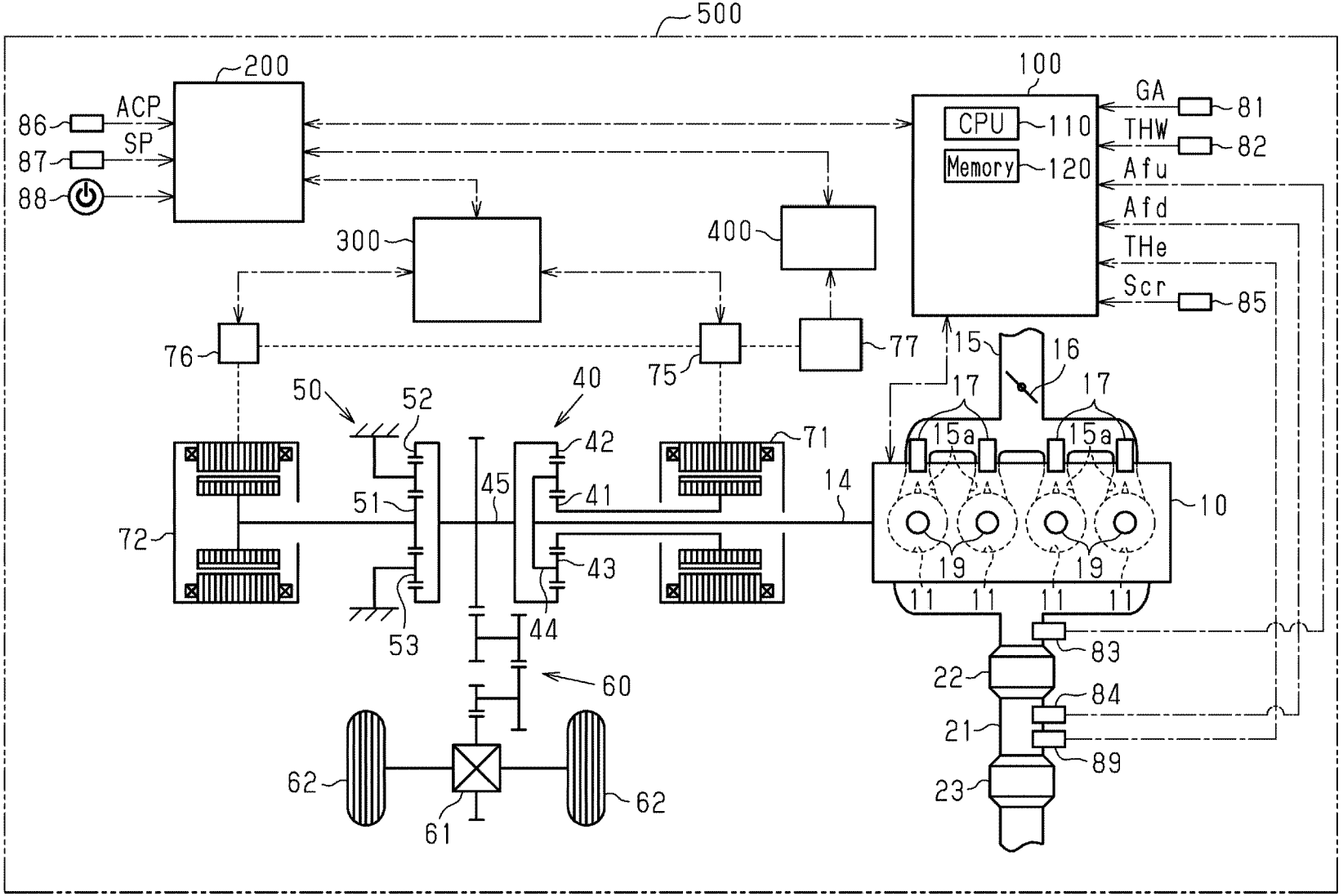
FIG. 1 is a schematic diagram showing the configuration of a hybrid vehicle equipped with a controller for an internal combustion engine according to an embodiment of the present disclosure.

FIG. 1 shows a hybrid vehicle (hereinafter referred to as a vehicle) 500 having a spark-ignition internal combustion engine 10 for which the controller 100 of the present embodiment is adapted. As shown in FIG. 1, the vehicle 500 has two motor generators, that is, a first motor generator 71 and a second motor generator 72, that can be used as both a motor and a generator. Furthermore, the vehicle 500 includes a battery 77, a first inverter 75, and a second inverter 76. When the first motor generator 71 and the second motor generator 72 perform as generators, the battery 77 stores power generated by the first and second motor generators 71, 72. When the first motor generator 71 and the second motor generator 72 perform as motors, the battery 77 supplies power stored in the battery 77 to the first and second motor generators 71, 72. The first inverter 75 regulates the amount of power transferred between the first motor generator 71 and the battery 77. The second inverter 76 regulates the amount of power transferred between the second motor generator 72 and the battery 77.

The vehicle 500 has a first planetary gear mechanism 40. The first planetary gear mechanism 40 has a sun gear 41, which is an external gear, and a ring gear 42, which is an internal gear coaxially arranged with the sun gear 41. Pinion gears 43 meshing with the sun gear 41 and the ring gear 42 are provided between the sun gear 41 and the ring gear 42. The pinion gears 43 are supported by a carrier 44 to be allowed to orbit and rotate. The carrier 44 is coupled to a crankshaft 14, which is the output shaft of the internal combustion engine 10. The sun gear 41 is coupled to the first motor generator 71. The ring gear 42 is connected to a ring gear shaft 45. The ring gear shaft 45 is coupled to driven wheels 62 via a speed reduction mechanism 60 and a differential mechanism 61. Also, the ring gear shaft 45 is coupled to the second motor generator 72 via the second planetary gear mechanism 50.

The second planetary gear mechanism 50 includes a sun gear 51, which is an external gear, and a ring gear 52, which is an internal gear coaxially arranged with the sun gear 51. Pinion gears 53 meshing with the sun gear 51 and the ring gear 52 are provided between the sun gear 51 and the ring gear 52. Each pinion gear 53 is rotational but is not allowed to orbit. The ring gear 52 is connected to the ring gear shaft 45. The sun gear 51 is connected to the second motor generator 72.

The internal combustion engine 10 has multiple cylinders 11. In addition, the internal combustion engine 10 is provided with an intake passage 15 serving as an air introducing passage to the cylinders 11. A throttle valve 16, which regulates the intake air amount, is provided in the intake passage 15. The intake passage 15 branches to correspond to each of the cylinders 11 on the downstream side of the throttle valve 16. The branching sections of the intake passage 15 are connected to intake ports **15*a* provided for the corresponding cylinders 11. Each intake port 15*a* is provided with a fuel injection valve 17. Each cylinder 11 is provided with an ignition device 19. The ignition device 19 ignites the air-fuel mixture drawn into the cylinder 11 by spark discharge. Further, the internal combustion engine 10 is provided with an exhaust passage 21 serving as a discharge passage for exhaust gas generated by combustion of air-fuel mixture in each cylinder 11. A three-way catalyst 22 configured to purify exhaust gas is provided in the exhaust passage 21. Further, a filter 23 for trapping particulate matter in exhaust gas is provided in the exhaust passage 21 downstream of the three-way catalyst 22**.

In the internal combustion engine 10, air-fuel mixture containing fuel injected from the fuel injection valves 17 is introduced to the cylinders 11. When the ignition device 19 ignites the air-fuel mixture, combustion takes place in the cylinder 11. Exhaust gas generated by the combustion is discharged from the inside of the cylinder 11 to the exhaust passage 21. In the three-way catalyst 22, oxidation of HC and CO in the exhaust gas and reduction of NOx take place.

Furthermore, the filter 23 traps particulate matter in the exhaust gas to purify the exhaust gas.

The vehicle 500 has the engine controller 100, a motor controller 300, and a vehicle controller 200. The engine controller 100 executes various types of control of the internal combustion engine 10. The motor controller 300 performs various types of control of the first motor generator 71 and the second motor generator 72. The vehicle controller 200 controls the engine controller 100 and the motor controller 300 in a centralized manner. Also, the vehicle 500 is equipped with a battery monitoring device 400, which monitors the state of charge (SOC) of the battery 77.

The battery monitoring device 400 is connected to the battery 77. The battery monitoring device 400 has a central processing unit (CPU) and a memory. The battery monitoring device 400 receives the current IB, the voltage VB, and the temperature TB of the battery 77. The battery monitoring device 400 calculates the state of charge SOC of the battery 77 by causing the CPU to execute programs stored in the memory based on at least the current IB, the voltage VB and the temperature TB.

The motor controller 300 is connected to the first inverter 75 and the second inverter 76. The motor controller 300 has a central processing unit (CPU) and a memory. The motor controller 300 controls the amount of power supplied from the battery 77 to the first motor generator 71 and the second motor generator 72 and the amount of power supplied to the battery 77 from the first motor generator 71 and the second motor generator 72 (that is, charging amount) by causing the CPU to execute programs stored in the memory.

The engine controller 100, the motor controller 300, and the battery monitoring device 400 are connected to the vehicle controller 200 via communication ports. The vehicle controller 200 also has a central processing unit (CPU) and a memory. The vehicle controller 200 executes various types of control by causing the CPU to execute programs stored in the memory.

The vehicle controller 200 receives the state of charge SOC of the battery 77 from the battery monitoring device 400. The vehicle controller 200 is connected to an accelerator pedal sensor 86, which detects the depression amount of the accelerator pedal by the driver (accelerator operation amount ACC), a vehicle speed sensor 87, which detects the vehicle speed SP, which is the traveling speed of the vehicle 500, and a power switch 88. The vehicle controller 200 receives output signals from sensors and switches. The power switch 88 is a switch for activating the system of the hybrid vehicle 500. When the vehicle driver turns on the power switch 88, the vehicle 500 is in a drivable state.

The vehicle controller 200 calculates the required power of the vehicle, which is the required value of the driving force of the vehicle 500, based on the accelerator operation amount ACP and the vehicle speed SP. In addition, the vehicle controller 200 calculates the engine required torque, the first motor required torque, and the second motor required torque based on the vehicle required power, the state of charge SOC, and the like. The engine required torque is a required value of the output torque of the internal combustion engine 10. The first motor required torque is a required value of the driving torque or regenerative torque of the first motor generator 71. The second motor required torque is a required value of the driving torque or regenerative torque of the second motor generator 72. The engine controller 100 controls the power of the internal combustion engine 10 in accordance with the engine required torque. The motor controller 300 executes a torque control necessary to drive of the vehicle 500 by executing a torque control of the first motor generator 71 and the second motor generator 72 in accordance with the first motor required torque and the second motor required torque.

The engine controller 100 includes a central processing unit (hereinafter, referred to as a CPU) 110 and a memory 120, which stores programs and data that are used in control. The CPU 110 executes programs stored in the memory 120 to execute various types of engine control.

The engine controller 100 is connected to an air flowmeter 81, a coolant temperature sensor 82, and a crank angle sensor 85. The air flowmeter 81 is an intake air amount sensor that detects an intake air amount GA. The coolant temperature sensor 82 detects a coolant temperature THW, which is the temperature of the coolant of the internal combustion engine 10. The crank angle sensor 85 detects the rotational angle of the crankshaft 14. The engine controller 100 receives output signals from the above-described sensors. The engine controller 100 is also connected to a first air-fuel ratio sensor 83, which is provided in the exhaust passage 21 on the upstream side of the three-way catalyst 22 and a second air-fuel ratio sensor 84, which is provided in the exhaust passage 21 between the three-way catalyst 22 and the filter 23. The engine controller 100 also receives output signals from the above-described sensors.

The first air-fuel ratio sensor 83 and the second air-fuel ratio sensor 84 are sensors that detect the state of oxygen concentration of the exhaust gas, and output signals proportional to the oxygen concentration of the exhaust gas. The first air-fuel ratio sensor 83 detects an upstream-side air-fuel ratio Afu, which indicates the oxygen concentration of the exhaust gas flowing into the three-way catalyst 22. The second air-fuel ratio sensor 84 detects a downstream-side air-fuel ratio Afd, which indicates the oxygen concentration of the exhaust gas (hereinafter, referred to as exit gas) after passing through the three-way catalyst 22. The engine controller 100 is also connected to a temperature sensor 89 provided in the exhaust passage 21 between the three-way catalyst 22 and the filter 23. The temperature sensor 89 detects a catalyst exit gas temperature THe, which is the temperature of the exhaust gas after passing the three-way catalyst 22. The engine controller 100 also receives output signals from this sensor.

The engine controller 100 calculates an engine rotational speed NE based on an output signal Scr of the crank angle sensor 85. In addition, the engine controller 100 calculates an engine load factor KL based on the engine rotational speed NE and the intake air amount GA. The engine load factor KL is the ratio of the current cylinder inflow air amount to the cylinder inflow air amount when the internal combustion engine 10 is in a steady operation state with the throttle valve 16 fully open at the current engine rotational speed NE. The cylinder inflow air amount is the amount of air that flows into each cylinder 11 in the intake stroke.

The engine controller 100 calculates a catalyst temperature Tsc, which is the temperature of the three-way catalyst 22, and a filter temperature Tf, which is the temperature of the filter 23, based on the catalyst exit gas temperature THe and various types of engine operating states such as the intake charging efficiency and the engine rotational speed NE. Also, the engine controller 100 calculates a PM deposition amount Ps based on the engine rotational speed NE, the engine load factor KL, the filter temperature Tf, and the like. The PM deposition amount Ps is the amount of particulate matter deposited on the filter 23.

In addition, the engine controller 100 executes an air-fuel ratio feedback control that corrects the fuel injection amount of the fuel injection valve 17 based on the detection values of the first air-fuel ratio sensor 83 and the second air-fuel ratio sensor 84.

The vehicle controller 200 requests the engine controller 100 to stop the combustion operation of the internal combustion engine 10 when the vehicle 500 is in a stopped state or traveling at a low speed, on condition that the state of charge SOC of the battery 77 is above a specified charge requiring value. When a request for stopping the combustion operation is made, the engine controller 100 stops both the fuel injection of the fuel injection valve 17 and the spark discharge of the ignition device 19 to stop the combustion operation of the internal combustion engine 10.

As described above, the collected particulate matter in exhaust gas is deposited on the filter 23 provided in the exhaust passage 21. When the deposition amount of particulate matter increases, the filter 23 may become clogged. In order to burn and remove the particulate matter deposited on the filter 23, the temperature of the filter 23 needs to be higher than or equal to the ignition point of the particulate matter. The three-way catalyst 22 is arranged in the exhaust passage 21 on the upstream side of the filter 23. As the temperature of the three-way catalyst 22 (catalyst temperature) increases, the temperature of the gas flowing from the three-way catalyst 22 to the filter 23 also increases. Due to the heat received from the high temperature gas flowing in, the temperature of the filter 23 also increases. Thus, increasing the temperature of the three-way catalyst 22 burns the particulate matter deposited on the filter 23. Therefore, in the present embodiment, when the deposition amount of the particulate matter in the filter 23 is increased, a catalyst temperature increase control is executed to increase the catalyst temperature to burn and remove the particulate matter deposited on the filter 23.

Figure 2:
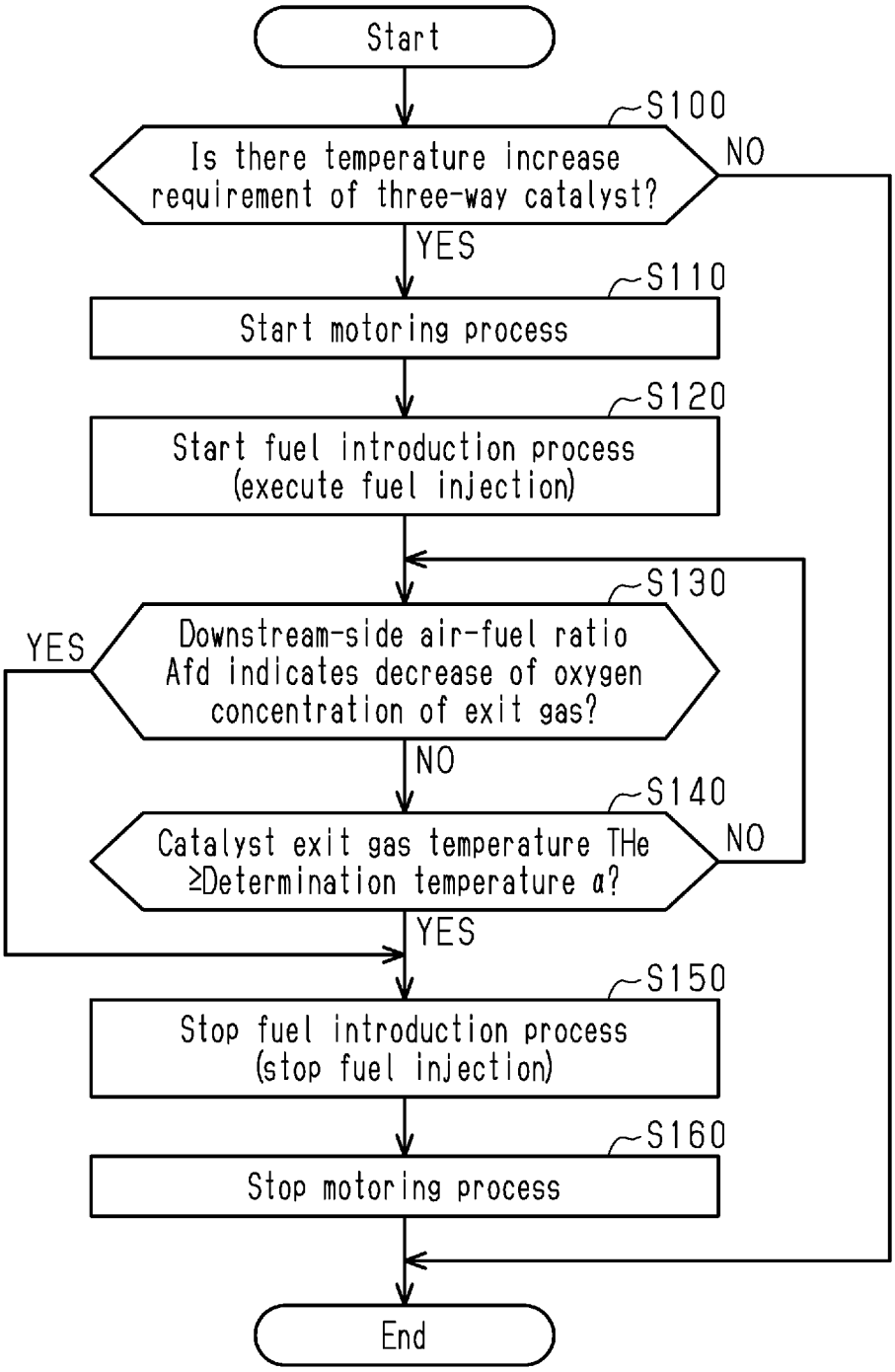
FIG. 2 is a flowchart showing a procedure of a catalyst temperature increase control executed by the controller.

FIG. 2 shows the procedure of the catalyst temperature increase control. The series of processes shown in FIG. 2 is started when the combustion operation of the internal combustion engine 10 is stopped and the rotation of the crankshaft 14 is stopped. This process is implemented by the CPU 110 executing programs stored in the memory 120 of the engine controller 100. In the following description, the number of each step is represented by the letter S followed by a numeral.

When this process is started, the CPU 110 first determines whether there is a temperature increase requirement of the three-way catalyst 22 (S100). In the present embodiment, the CPU 110 determines that there is a temperature increase requirement of the three-way catalyst 22 when the PM deposition amount Ps is greater than a predetermined specified amount and the catalyst exit gas temperature THe is lower than regenerable temperature of the filter 23. The regenerable temperature is set to the lower limit value of the catalyst exit gas temperature THe necessary to bring the temperature of the filter 23 to or beyond the ignition point of the particulate matter.

If it is determined that there is no temperature increase requirement of the three-way catalyst 22 (S100: NO), the CPU 110 ends the current process. In contrast, if it is determined that there is a temperature increase requirement of the three-way catalyst 22 (S100: YES), the CPU 110 starts a motoring control (S110). The motoring control is a control that rotates the crankshaft 14 with the power of the first motor generator 71 in a state in which the combustion operation of the internal combustion engine 10 is stopped. When the motoring control is started to rotate the crankshaft 14, intake and exhaust are performed in each cylinder 11.

In the motoring control, the rotational speed of the first motor generator 71 is controlled such that the engine rotational speed NE becomes greater than or equal to a specified temperature increasing rotational speed y. The temperature increasing rotational speed y is an engine rotational speed at which the flow rate of air discharged to the exhaust passage 21 is the minimum flow rate necessary to increase the catalyst temperature.

After starting the motoring control, the CPU 110 starts a fuel introduction process. In the fuel introduction process, the fuel injection of the fuel injection valve 17 is performed in a state in which the spark discharge of the ignition device 19 is stopped. The fuel injection amount of the fuel injection valve 17 during the execution of the fuel introduction process is controlled such that the air-fuel ratio of the air-fuel mixture is leaner than the stoichiometric air-fuel ratio.

At the start of the fuel introduction process, intake and exhaust are performed in each cylinder 11 through the motoring control. The air-fuel mixture containing the fuel injected from the fuel injection valve 17 is thus introduced into the exhaust passage 21 without being burned. As the unburned air-fuel mixture flows into the three-way catalyst 22 and is burned in the three-way catalyst 22, the catalyst temperature increases.

Next, the CPU 110 determines whether the downstream-side air-fuel ratio Afd has indicated a decrease in the oxygen concentration of the exit gas (S130). In the present embodiment, if the downstream-side air-fuel ratio Afd starts to change to a rich-side value while the fuel introduction process is being executed, the CPU 110 determines that the downstream-side air-fuel ratio Afd indicates a decrease in the oxygen concentration of the exit gas.

If the downstream-side air-fuel ratio Afd indicates a decrease in the oxygen concentration (S130: YES), the CPU 110 stops the fuel introduction process by stopping the fuel injection from the fuel injection valve 17 (S150). The CPU 110 also stops the motoring control (S160). Then, the CPU 110 ends the current process.

In contrast, if the downstream-side air-fuel ratio Afd does not indicate a decrease in the oxygen concentration of the exit gas (S130: NO), the CPU 110 determines whether the catalyst exit gas temperature THe is greater than or equal to a specified determination temperature a. (S140). The determination temperature a is set to a temperature higher than the regenerable temperature mentioned above.

If the catalyst exit gas temperature THe is less than the prescribed determination temperature a (S140: NO), the CPU 110 repeatedly executes the process after S130. If the catalyst exit gas temperature THe is greater than or equal to the specified determination temperature a (S140: YES), the CPU 110 stops the fuel introduction process by stopping the fuel injection from the fuel injection valve 17 (S150). The CPU 110 also stops the motoring control (S160). Then, the CPU 110 ends the current process. In this process, the process of S130 and the process of S150 correspond to a stopping process of stopping the fuel introduction process when the detection value of the sensor indicates a decrease in the oxygen concentration of the exit gas during the execution of the fuel introduction process.

The operation and advantages of the present embodiment will now be described.

Figure 3:
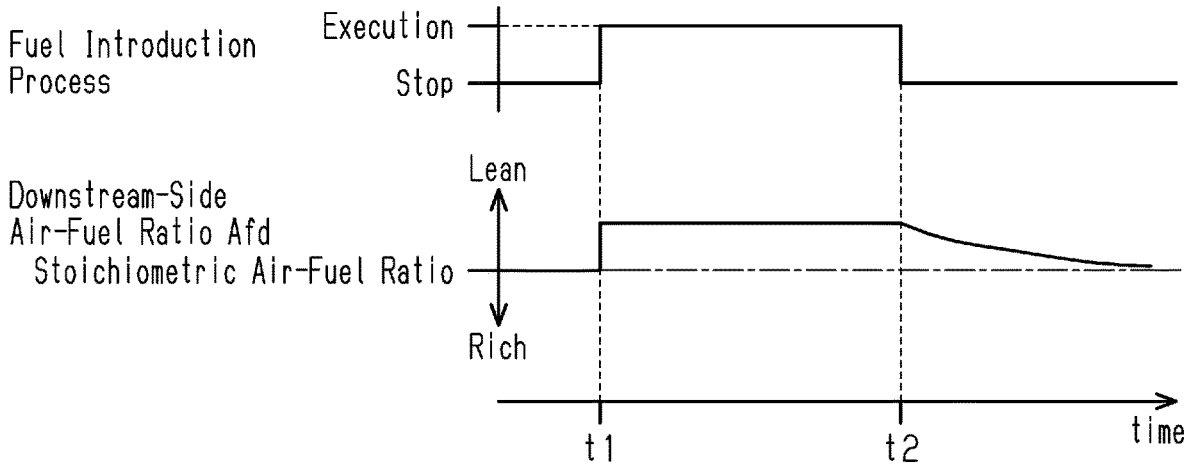
FIG. 3 is a timing diagram showing the operation of the embodiment.

FIG. 3 shows a manner in which the fuel introduction process is executed. In this case, the actual amount of fuel injected by the fuel injection valve 17 is greater than the injection amount instructed by the engine controller 100. Also, the fuel concentration in the air-fuel mixture is high enough to make the air-fuel ratio of the unburned air-fuel mixture introduced into the exhaust passage 21 richer than the stoichiometric air-fuel ratio.

As shown in FIG. 3, in a case in which the combustion operation of the internal combustion engine 10 is in a stopped state at a point in time t1, if there is a temperature increase requirement of the three-way catalyst 22, the catalyst temperature increase control is executed to start the fuel introduction process. At the start of the fuel introduction process, the motoring control is also started.

The execution of the fuel introduction process causes unburned air-fuel mixture of a high fuel concentration to flow into the three-way catalyst 22 as described above. Then, the fuel reacts with oxygen contained in the air-fuel mixture to be burned. The combustion of the fuel puts the three-way catalyst 22 in a reducing atmosphere. The three-way catalyst 22 thus releases the stored oxygen. Some of the oxygen released from the three-way catalyst 22 is burned by reacting with the fuel that has not reacted with the oxygen contained in the air-fuel mixture, and the remaining oxygen flows out from the three-way catalyst 22 to the exhaust passage 21.

As described above, even if unburned air-fuel mixture of a high fuel concentration flows into the three-way catalyst 22 through the execution of the fuel introduction process, oxygen is released from the three-way catalyst 22, so that the oxygen concentration of the exit gas flowing out of the three-way catalyst 22 is high. Therefore, the downstream-side air-fuel ratio Afd after the point in time t1 indicates an air-fuel ratio significantly leaner than that during the combustion operation of the internal combustion engine 10. In the case of FIG. 3, the value of the downstream-side air-fuel ratio Afd when indicating a significantly lean air-fuel ratio is a lean limit value, which is the limit value on the lean side of the air-fuel ratio detection range detectable by the second air-fuel ratio sensor 84.

When the oxygen storage amount of the three-way catalyst 22 decreases during the execution of the fuel introduction process, the amount of oxygen released from the three-way catalyst 22 also decreases. This decreases the amount of oxygen that has been released from the three-way catalyst 22 and flows into the exhaust passage 21 without reacting with the fuel. Thus, the oxygen concentration of the exit gas flowing out of the three-way catalyst 22 begins to decrease (point in time t2). Therefore, the value of the downstream-side air-fuel ratio Afd, which represents the lean limit value, starts to change to the rich side. If the fuel induction process is continued after the point in time t2, some of the fuel supplied to the three-way catalyst 22 starts passing through the three-way catalyst 22 without being burned due to the lack of the amount of oxygen released from the three-way catalyst 22.

As such, in the present embodiment, the CPU 110 stops the fuel introduction process by stopping the fuel injection from the fuel injection valve 17 at the time when the value of the downstream-side air-fuel ratio Afd starts to change to the rich side during the execution of the fuel introduction process (point in time t2). This limits the deterioration of emissions due to the unburned fuel passing through the three-way catalyst 22.

The above described embodiment may be modified as follows. The above-described embodiment and the following modifications can be combined as long as the combined modifications remain technically consistent with each other.

In the above-described embodiment, the second air-fuel ratio sensor 84, which outputs a signal proportional to the oxygen concentration of the exit gas, is provided as a sensor for detecting the state of the oxygen concentration of the exit gas that has passed through the three-way catalyst 22.

Figure 4:
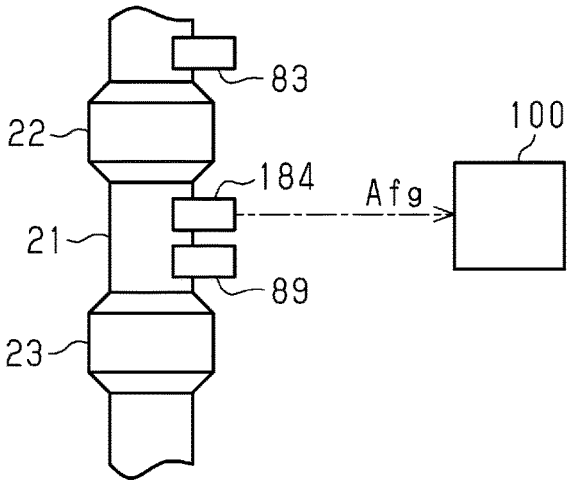
FIG. 4 is a schematic diagram showing the exhaust system of an internal combustion engine in a modification of the embodiment.

Alternatively, as shown in FIG. 4, an oxygen sensor 184 that detects only the presence or absence of oxygen in the exit gas may be provided as a sensor for detecting the state of the oxygen concentration of the exit gas that has passed through the three-way catalyst 22. The oxygen sensor 184 is characterized in that its output voltage changes rapidly when the air-fuel ration changes across the stoichiometric air-fuel ratio. That is, if the air-fuel ratio of the air-fuel mixture is richer than the stoichiometric air-fuel ratio and there is no oxygen in the exhaust gas, the oxygen sensor 184 gives an output voltage of about 1 volt. The downstream air-fuel ratio Afg that is detected by the oxygen sensor 184 at this time indicates a rich state, in which there is no oxygen in the exhaust gas. Also, if the air-fuel ratio of the air-fuel mixture is leaner than the stoichiometric air-fuel ratio and there is oxygen in the exhaust gas, the oxygen sensor 184 gives an output voltage of about 0 volts. The downstream air-fuel ratio Afg that is detected by the oxygen sensor 184 at this time indicates a lean state, in which there is oxygen in the exhaust gas.

Figure 5:
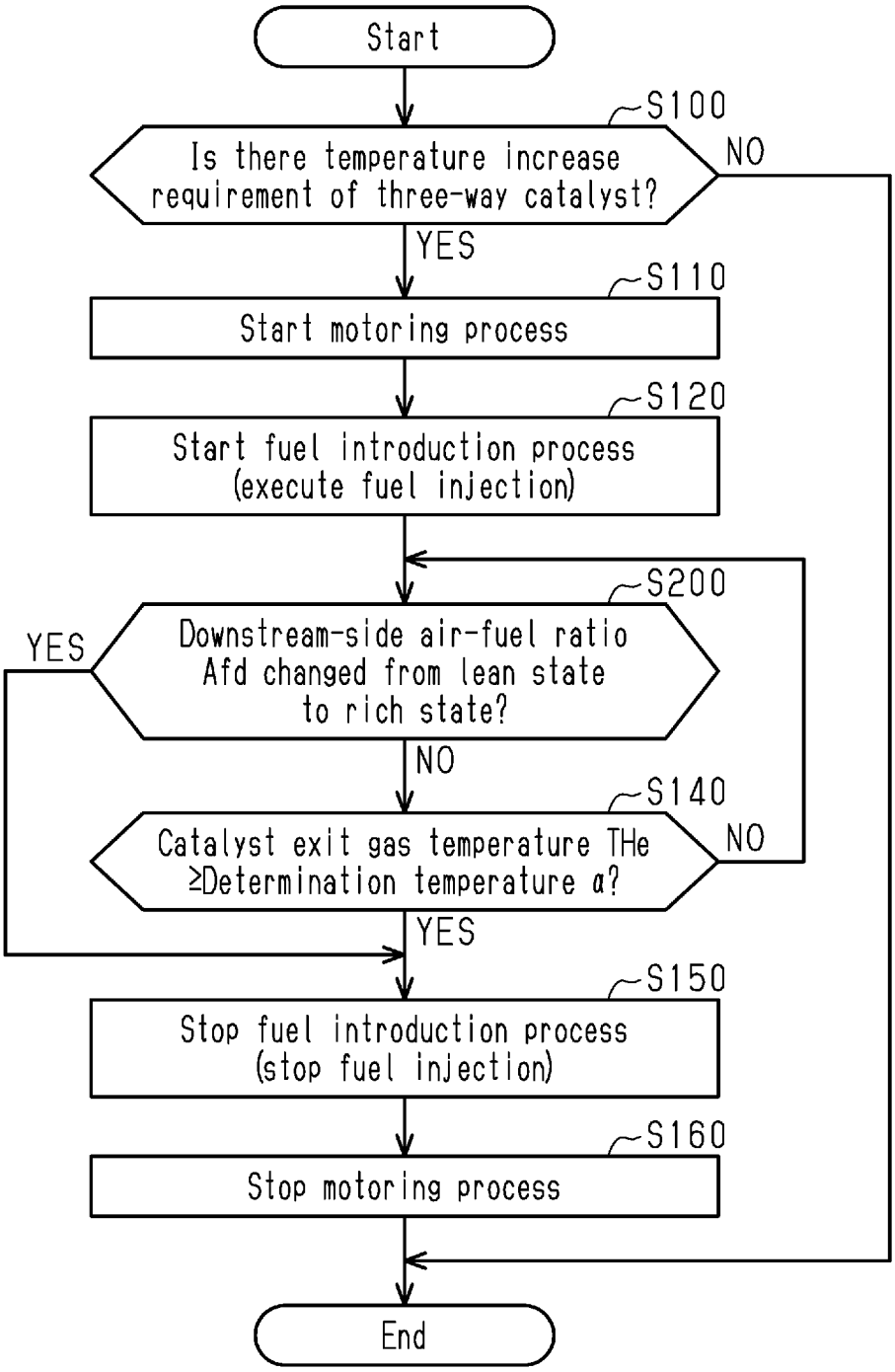
FIG. 5 is a flowchart showing a procedure of a catalyst temperature increase control in a modification of the embodiment.

Then, by executing the process of S200 shown in FIG. 5 instead of the process of S130 in the procedure of the catalyst temperature increase control described in FIG. 2, it is determined whether the oxygen concentration of the exit gas has decreased during the execution of the fuel introduction process. That is, the CPU 110 determines in S200 whether the downstream-side air-fuel ratio Afg has changed from a lean state to a rich state. If the downstream-side air-fuel ratio Afg has changed from a lean state to a rich state (S200: YES), the CPU 110 determines that the oxygen concentration of the exit gas has decreased and stops the fuel introduction process by stopping the fuel injection from the fuel injection valve 17 (S150). The CPU 110 also stops the motoring control (S160). Then, the CPU 110 ends the current process.

In contrast, if the downstream-side air-fuel ratio Afg has not changed from a lean state to a rich state (S200: NO), the CPU 110 determines whether the catalyst exit gas temperature THe is greater than or equal to a specified determination temperature a. (S140). If the catalyst exit gas temperature THe is less than the prescribed determination temperature a (S140: NO), the CPU 110 repeatedly executes the process after S200. In this modification, the process of S200 and the process of S150 correspond to a stopping process of stopping the fuel introduction process when the detection value of the sensor indicates a decrease in the oxygen concentration of the exit gas during the execution of the fuel introduction process.

Even in the above-described modification, when the oxygen concentration of the exit gas that has passed through the three-way catalyst 22 decreases during the execution of the fuel introduction process, the stopping process is executed to stop the fuel introduction process. This limits the deterioration of emissions due to the unburned fuel passing through the three-way catalyst 22.

While the fuel introduction process is being executed, spark discharge of the ignition device 19 is stopped. In addition, while the fuel introduction process is being executed, spark discharge of the ignition device 19 may be performed in a period in which the air-fuel mixture is not burned in the cylinder 11. For example, if spark discharge is performed when the piston in the cylinder 11 is located near the bottom dead center, the air-fuel mixture is not burned in the cylinder 11. Therefore, even if spark discharge is performed during the execution of the fuel introduction process, the fuel injected from the fuel injection valve 17 can be introduced into the exhaust passage 21 from inside the cylinder 11 without being burned.

In the above-described embodiment, the fuel introduction process is executed through the fuel injection into the intake port 15*a* by the fuel injection valve 17. Alternatively, it is also possible to execute the fuel introduction process through fuel injection into the cylinder 11 in an internal combustion engine equipped with a fuel injection valve of a direction injection type, which injects fuel into the cylinder 11.

The present disclosure may be adapted for a system different from the hybrid vehicle system shown in FIG. 1 as long as the rotational speed of the crankshaft 14 is controlled by driving a motor.

The present disclosure may be adapted for vehicles that do not have a power source other than the internal combustion engine. Even in this case, if the vehicle is traveling without performing combustion of air-fuel mixture in the cylinder, that is, if the vehicle is coasting, the crankshaft is rotated by the power transmitted from the driven wheels. Therefore, the temperature of the three-way catalyst can be increased if the fuel introduction process is executed while the vehicle is coasting and the crankshaft is rotating.

The engine controller 100 is not limited to a device that includes the CPU 110 and the memory 120 and executes software processing. For example, a dedicated hardware circuit (such as an ASIC) may be provided that executes at least part of the software processing executed in each of the above-described embodiments. That is, the engine controller 100 may be modified as long as it has any one of the following configurations (a) to (c). (a) A configuration including a processor that executes all of the above-described processes according to programs and a program storage device such as a memory that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for an internal combustion engine, wherein the internal combustion engine includes:

a fuel injection valve, a cylinder into which air-fuel mixture containing fuel injected by the fuel injection valve is introduced, an ignition device that spark-ignites the air-fuel mixture introduced into the cylinder, an exhaust passage through which gas discharged from inside the cylinder flows, a three-way catalyst provided in the exhaust passage, and a sensor that is provided in the exhaust passage and detects a state of an oxygen concentration of exit gas, which is gas that has passed through the three-way catalyst, and the controller is configured to execute:

a fuel introduction process of introducing, in a state in which a crankshaft of the internal combustion engine is rotating, the air-fuel mixture that contains the fuel injected by the fuel injection valve into the exhaust passage without burning the air-fuel mixture in the cylinder; and a stopping process of stopping the fuel introduction process when the oxygen concentration that was detected by the sensor has been changed from a lean state to a rich state with reference to oxygen concentration at the stoichiometric air-fuel ratio during the execution of the fuel introduction process.

2. The controller for an internal combustion engine according to claim 1, wherein the sensor is an air-fuel ratio sensor that outputs a signal proportional to the oxygen concentration of the exhaust gas, and the controller is configured to stop the fuel introduction process when the oxygen concentration that was detected by the air-fuel ratio sensor has been changed from a lean state to a rich state with reference to oxygen concentration at the stoichiometric air-fuel ratio during the execution of the fuel introduction process.

3. The controller for an internal combustion engine according to claim 1, wherein the sensor is an oxygen sensor that detects only presence or absence of oxygen in the exit gas, and the controller is configured to stop the fuel introduction process when a detection value of the oxygen sensor changes from a value indicating presence of oxygen to a value indicating absence of oxygen during the execution of the fuel introduction process.

4. A controller for an internal combustion engine, wherein the internal combustion engine includes:

a fuel injection valve, a cylinder into which air-fuel mixture containing fuel injected by the fuel injection valve is introduced, an ignition device that spark-ignites the air-fuel mixture introduced into the cylinder, an exhaust passage through which gas discharged from inside the cylinder flows, a three-way catalyst provided in the exhaust passage, and a sensor that is provided in the exhaust passage and detects a state of an oxygen concentration of exit gas, which is gas that has passed through the three-way catalyst, and the controller includes circuitry that is configured to execute:

a fuel introduction process of introducing, in a state in which a crankshaft of the internal combustion engine is rotating, the air-fuel mixture that contains the fuel injected by the fuel injection valve into the exhaust passage without burning the air-fuel mixture in the cylinder; and a stopping process of stopping the fuel introduction process when the oxygen concentration that was detected by the sensor has been changed from a lean state to a rich state with reference to oxygen concentration at the stoichiometric air-fuel ratio during the execution of the fuel introduction process.

5. A control method for an internal combustion engine, wherein the internal combustion engine includes:

a fuel injection valve, a cylinder into which air-fuel mixture containing fuel injected by the fuel injection valve is introduced, an ignition device that spark-ignites the air-fuel mixture introduced into the cylinder, an exhaust passage through which gas discharged from inside the cylinder flows, a three-way catalyst provided in the exhaust passage, and a sensor that is provided in the exhaust passage and detects a state of an oxygen concentration of exit gas, which is gas that has passed through the three-way catalyst, and the control method comprises:

in a fuel introduction process, introducing, in a state in which a crankshaft of the internal combustion engine is rotating, the air-fuel mixture that contains the fuel injected by the fuel injection valve into the exhaust passage without burning the air-fuel mixture in the cylinder; and in a stopping process, stopping the fuel introduction process when the oxygen concentration that was detected by the sensor has been changed from a lean state to a rich state with reference to oxygen concentration at the stoichiometric air-fuel ratio during the execution of the fuel introduction process.

* * * * *